US007263313B2

(12) United States Patent
Kim et al.

(10) Patent No.: US 7,263,313 B2
(45) Date of Patent: Aug. 28, 2007

(54) DRIVING APPARATUS WITH POWER DISCONNECTING PART, IMAGE FORMING APPARATUS HAVING THE SAME, AND METHOD OF DRIVING THE IMAGE FORMING APPARATUS

(75) Inventors: Hyun-soo Kim, Yongin-si (KR); Hyung-seong Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 155 days.

(21) Appl. No.: 11/170,039

(22) Filed: Jun. 30, 2005

(65) Prior Publication Data

US 2006/0067736 A1 Mar. 30, 2006

(30) Foreign Application Priority Data

Sep. 24, 2004 (KR) ..... 10-2004-0076894

(51) Int. Cl.
*G03G 15/00* (2006.01)
*G03G 15/20* (2006.01)

(52) U.S. Cl. ..... 399/167; 399/21; 399/67; 399/75; 399/101

(58) Field of Classification Search ..... 399/75, 399/67, 21, 99, 66, 167, 101, 320, 297; 347/156
See application file for complete search history.

(56) References Cited

U.S. PATENT DOCUMENTS 4,598,990 A * 7/1986 Kusumoto et al. ..... 399/75
5,740,503 A * 4/1998 Nakamura ..... 399/167
7,127,186 B2 * 10/2006 Fujita et al. ..... 399/67 X

FOREIGN PATENT DOCUMENTS

| | | |
|---|---|---|
| JP | 61-267076 | 11/1986 |
| JP | 03-261964 | 11/1991 |
| JP | 05-119635 | 5/1993 |
| JP | 11-030925 | 2/1999 |
| JP | 11-231670 | 8/1999 |
| JP | 11-352820 | 12/1999 |
| JP | 2004-045999 | 2/2004 |
| KR | 10-2004-0018719 A | 3/2004 |

* cited by examiner

*Primary Examiner*—Sophia S. Chen
(74) *Attorney, Agent, or Firm*—Roylance, Abrams, Berdo & Goodman, LLP

(57) ABSTRACT

A driving apparatus with a power disconnecting part for disconnecting power transmitted to an image fixing unit while an image formed on an image transfer belt is cleaned when a paper jam occurs, and an image forming apparatus and method for performing the same. The image forming apparatus includes a driving motor, a belt unit driving part having a belt driving gear connected to the driving motor to drive an image belt, an image fixing unit driving part having an image fixing gear for driving an image fixing roller for fixing a toner image onto a recording medium, a power disconnecting part for transmitting the power of the driving motor of the belt unit driving part to the image fixing unit driving part or for disconnecting the power transmission of the driving motor from the image fixing unit driving part, and a power disconnection actuating part for actuating the power disconnecting part.

20 Claims, 8 Drawing Sheets

DRIVING APPARATUS WITH POWER DISCONNECTING PART, IMAGE FORMING APPARATUS HAVING THE SAME, AND METHOD OF DRIVING THE IMAGE FORMING APPARATUS

CROSS-REFERENCE TO RELATED APPLICATIONS

This application claims the benefit under 35 U.S.C. §119 (a) of Korean Patent Application No. 10-2004-0076894 filed in the Korean Intellectual Property Office on Sep. 24, 2004, the entire disclosure of which is incorporated herein by reference.

BACKGROUND OF THE INVENTION

1. Field of the Invention

The present invention relates to an image forming apparatus such as an electrophotographic printer. More particularly, the present invention relates to a driving apparatus having a power disconnecting part which disconnects power transmitted to an image fixing unit while an image formed on an image transfer belt is being cleaned when a paper jam occurs, an image forming apparatus having such a driving apparatus, and a method for driving the same.

2. Description of the Related Art

In general, an image forming apparatus such as an electrophotographic printer forms an electrostatic latent image on a photoconductor such as a photoconductive belt or an organic photoconductive (OPC) drum, develops the latent image with developer having a predetermined color, and then transfers the developed image onto a recording paper, thereby obtaining a desired image. Such an electrophotographic image forming apparatus is classified into categories including wet type or dry type depending on the developer employed therein, wherein a wet-type uses liquid developer, formed by mixing powdered toner with a liquid carrier of volatile compounds, as the developer.

FIG. 1 shows a conventional wet-type electrophotographic color printer using a liquid developer.

As shown in FIG. 1, a wet-type electrophotographic color printer 1 comprises an image forming unit 5, an image transfer belt unit 10, an image fixing unit 21, a paper discharge unit 30, and a cleaning unit 50.

The image forming unit 5 comprises four laser scanning units 11, four charging rollers 12, four photoconductors 9, and four developing devices 13, to form an image of four colors, for example, black, yellow, cyan, and magenta.

FIG. 2 is a schematic view exemplifying a developing device and a photoconductor as shown in FIG. 1. As shown in FIG. 2, each developing device 13 comprises a storage part 6, a developing roller 7, a deposit roller 14, a metering roller 15, and a cleaning roller 16. The storage part 6 contains a reserve of liquid developer. The developing roller 7 is located below a corresponding photoconductor 9. The deposit roller 14 is located below the developing roller 7 and applies an electric force to the developing roller 7, thereby forming a layer of charged developer on the developing roller 7. Each metering roller 15 applies a predetermined level of voltage to the charged developer layer formed on the developing roller 7 by the deposit roller 14, so that a greater amount of toner is deposited on the developing roller 7. At the same time, the metering roller 15 limits the charged developer layer to a developer layer having a predetermined amount of toner or density (that is, solid %) and supplies the limited developer layer to a nip between the developing roller 7 and the conductor body 9.

The deposit roller 14 and the metering roller 15 serve to supply a layer of developer containing a constant amount of toner or toner density, regardless of a high density liquid developer 48 (for example, a denisity of about 3-40 solid %) or regardless of a fluctuating density of the liquid developer 48 (for example, a density fluctuated while being used), to the nip between the developer roller 7 and the photoconductor 9.

Each of the photoconductors 9 consist of an OPC drum, and the photoconductors 9 each form a different color toner image from one another, depending on the respective corresponding developing devices 13.

Returning to FIG. 1, the image transfer belt unit 10 comprises four first image transfer rollers 8, a second image transfer roller 23, and an image transfer belt 17. The image transfer belt 17 rotates along a path over an endless track on first, second, and third support rollers 19, 20, and 24. Each of the first image transfer rollers 8 transfers a toner image formed on a corresponding photoconductor 9 to the image transfer belt 17, and the second image transfer roller 23 transfers the toner image transferred to the image transfer belt 17 to a recording medium P.

The image fixing unit 21 comprises first and second heating rollers 25 and 27, and first and second compressing rollers 26 and 28. The first and second heating rollers 25 and 27 apply heat to the toner image transferred to the recording medium P, and the first and second compressing rollers 26 and 28 compresses the recording medium P against the first and second heating rollers 25 and 27 with a predetermined pressure. The recording medium P with the image fixed by the heat and pressure applied by the first and second heating rollers 25 and 27 and the first and second compressing rollers 26 and 28, is then discharged out of the printer 1 by the first and second paper-discharge rollers 31 and 32 and the first and second paper-discharge backup rollers 33 and 34.

The cleaning unit 50 comprises a cleaning blade 51 for removing an image remaining on the image transfer belt 17, and a waste developer storage part 52 for containing a reserve of waste developer removed by the cleaning blade 51.

The conventional wet-type electrophotographic printer 1 configured as described above is operated as described in greater detail below.

As a print command is applied, the image forming units 5 operate respective components thereof to perform a series of image forming operations for forming images of four colors.

Specifically, each photoconductor 9 is formed with a charged layer, that is, an electrostatic latent image corresponding to a color image to be printed, by a corresponding charging roller 12 and a corresponding scanning roller 11. A part of each photoconductor 9 having the electrostatic latent image is then deposited with toner from a developer layer having a predetermined amount of toner by a corresponding developing roller 7. The developing roller 7 communicates the toner from the liquid developer 48 of a corresponding storage part 6 using a corresponding deposit roller 14 and a corresponding metering roller 15, such that a toner image is formed on each photoconductor 9.

At this time, the liquid developer 48 is formed as a charged developer layer on the developing rollers 7 by the electric force exerted by the respective deposit rollers 14 and a predetermined level of voltage applied by the metering rollers 15, whereby the liquid developer 48 is formed on the developing rollers 7 as a developer layer containing a predetermined amount of toner.

The images developed on the respective photoconductors 9 by the respective corresponding developing devices 13 are primarily transferred to the image transfer belt 17 from the photoconductors 9 by the voltage and pressure exerted by the first image transfer rollers 8 located inside the path of the image transfer belt 17. The toner images transferred to the image transfer belt 17 are moved to the second image transfer roller 23 as the image transfer belt 17 is rotated along the first, second, and third support rollers 19, 20, and 24, by a belt driving roller 22. In a secondary transfer, the toner images are then transferred to the recording medium P by the voltage and pressure exerted by the second image transfer roller 23.

The images transferred to the recording medium P are fixed on the recording medium P by the first and second heating rollers 25 and 27, and the first and second compressing rollers 26 and 28, thus forming a desired image.

Thereafter, the recording medium P is discharged out of the printer 1 by the first and second paper-discharge rollers 31 and 32, and the first and second paper-discharge backup rollers 33 and 34, of the paper discharge unit 30.

After the images transferred to the image transfer belt 17 have been transferred to the recording medium P, the image transfer belt 17 is continuously rotated and arrives at the cleaning blade 51 mounted in such a manner that the cleaning blade 51 comes into contact with the image forming surface of the image transfer belt 17 at a side of the third support roller 24, wherein developer residue remaining on the surface of the image transfer belt 17 is removed from the image transfer belt 17 by the cleaning blade 51 and recovered by the waste developer storage part 52 so as to allow the printer 1 to print a next image. In a conventional printer, only 90-98% of the developer is transferred to a recording paper, rather than the entire 100%. Accordingly, the remaining 2-10% of the developer is collected by the cleaning blade 51.

The image transfer belt 17 then repeats the above-mentioned operations through the respective photoconductors 9, the respective laser scanning units 11, and the respective developing devices 13, after the remaining developer residue has been removed from the image transfer belt 17.

The conventional printer 1 described above is configured so that a paper jam can be easily removed through a user's simple actions, such as when a jam occurs in the printer as the recording medium P is caught or slipped during the secondary image transfer for transferring a toner image on the image transfer belt 17 to a recording medium P, or while the toner image is being fixed to the recording medium P. Therefore, when a jam occurs, a toner image remaining on the image transfer belt 17 that has not been transferred to the recording medium P, can be transferred to another recording medium P or transferred to the waste developer storage part 52 when the printer is operated again after the jam is removed.

However, when a serious jam occurs, such as an accordion jam or lap jam, which is difficult to remove by a user, the user will typically require a skilled engineer. In this event, a toner image remaining on the image transfer belt 17 that has not been transferred to the recording medium P is left as it is for a long time until the jam is removed by a repairman. As a result, the toner image remaining on the image transfer belt 17 that has not been transferred to the recording medium P is adhered to the surface of the image transfer belt 17 in a solidified form as the liquid carrier of volatile compounds contained in the toner image is evaporated to the atmosphere. Thus, even if the printer 1 is operated again after the jam is removed, the toner adhered in a solidified form to the image transfer belt 17 damages other components, such as the cleaning blade 51 and the photoconductors 9. As a result, a fatal problem may occur, which deteriorates the quality of a final image.

In order to solve this problem, there have been attempts to implement software in such a way that when a jam occurs for example, when a recording medium P is caught or slipped during a series of image forming operations, and if the jam is not removed within a predetermined period, the image transfer belt 17 is forcibly urged to rotate further, thereby removing the toner image remaining on the image transfer belt 17 that has not been transferred to the recording medium P.

However, such a printer 1 is usually configured so that the power of the driving motor (not shown) for driving the image transfer belt 17 is also transmitted to the first and second heating rollers 25 and 27 of the image fixing unit 21 through the belt driving roller 22.

Therefore, if the image transfer belt 17 is forcibly urged to additionally rotate so as to remove the jam, the jammed recording medium P may be torn or the jam may grow even worse, depending on the position of the jammed recording medium P. For example, in a case where an accordion jam or lap jam occurs when a toner image transferred to the image transfer belt 17 is being secondarily transferred to a recording medium P by the voltage and pressure of the second image transfer roller 23, or when an image transferred to the recording medium P is being fixed by the first and second heating rollers 25 and 27 and the first and second compressing rollers 26 and 28, if the driving motor driving the image transfer roller 17 is driven, the first and second heating rollers 25 and 27 and the belt driving roller 22 connected to the driving motor are jointly rotated. As a result, a jam occurring between the image transfer belt 17 and the second image transfer roller 23, or between the first and second heating rollers 25 and 27 and the first and second compressing rollers 26 and 28, may grow worse to such an extent that the user cannot solve the problem. If the jam becomes too severe, gear parts for transmitting the power of the driving motor may become immovably stuck together, thus causing damage to the driving motor, or the recording medium P may become burned by the image fixing heat from the first and second heating rollers 25 and 27, whereby a fire may occur. In each event, the problem again results in the toner becoming adhered in a solidified form to the image transfer belt 17 as the toner image is left as the printer 1 stands until the jam is removed as described above, which deteriorates the reliability of the printer 1.

In addition, with the conventional printer 1, when a recording medium P is jammed between the first and second heating rollers 25 and 27 and the first and second compressing rollers 26 and 28 of the image fixing unit 21 as the recording medium P is caught or slipped during the image forming operation, a force exerted on the recording medium P when a user pulls the recording medium P by hand so as to remove the jam, is transmitted to the driving motor through the first and second heating rollers 25 and 27 and the belt driving roller 22. Accordingly, the recording medium P can be torn or seriously damaged by the load of the driving motor without being easily removed.

Accordingly, a need exists for an image forming apparatus which can prevent a toner image that has not been transferred to a recording medium P from being left on an image transfer belt as a printer stands, such as when a jam occurs at the time of the secondary image transfer operation of the image transfer belt 17 or during an image fixing operation, and which can prevent the jam from growing worse even if the image transfer belt 17 is additionally rotated so as to remove the toner image remaining on the image transfer belt 17, and which still further allows easy removal of the jam.

SUMMARY OF THE INVENTION

Accordingly, the present invention has been made to solve the above-mentioned and other problems and to provide additional advantages, and an object of the present invention is to provide a driving apparatus having a power disconnecting part for disconnecting power transmitted to an image fixing unit when a paper jam occurs, so that an image formed on an image transfer belt can be cleaned. The present invention further provides an image forming apparatus having such a driving apparatus, and a method of driving such an image forming apparatus.

Another object of the present invention is to provide a driving apparatus having a power disconnecting part for preventing a force exerted for removing a jam from being transmitted to a driving motor when the jam occurs at an image fixing unit. The present invention further provides an image forming apparatus having such a driving apparatus, and a method of driving such an image forming apparatus.

In order to achieve the above-mentioned and other objects, according to one aspect of the present invention, a driving apparatus is provided for an image forming apparatus comprising at least one driving motor, a belt unit driving part having a belt driving gear connected to the driving motor to drive an image belt, an image fixing unit driving part having an image fixing gear for driving an image fixing roller for fixing a toner image onto a recording medium, a power disconnecting part for transmitting the power of the driving motor of the belt unit driving part to the image fixing unit driving part or for disconnecting the power transmission from the image fixing unit driving part, and a power disconnection actuating part for actuating the power disconnecting part.

The image fixing unit driving part may further comprise a unidirectional power transmission part arranged in such a way that a force applied when the recording medium is pulled in the paper-discharge direction is not transmitted from the image fixing unit driving part to the driving motor. The unidirectional power transmission part is provided at one of a plurality of gears of the image fixing unit driving part, wherein the one gear has a first gear section and a second gear section. The unidirectional power transmission part comprises a swivel boss projected from one side of the first gear section, a first latch gear formed on the one side of the first gear section, a fixed boss projected from one side of the second gear section opposite to the one side of the first gear section and pivotably fixing and supporting the swivel boss, and a second latch gear formed on the one side of the second gear section. The first latch gear and the second latch gear are arranged in such a way that when one of the first and second latch gears rotates in one direction, they are meshed with each other so that power transmission from the one side to the other of the first and second latch gears is connected. The first latch gear and the second latch gear are further arranged in such a way that when the one of the first and second latch gears rotates in the opposite direction, the first latch gear and the second latch gear pass freely over each other so that power transmission from the one side to the other of the first and second latch gears is disconnected.

Preferably, the power disconnecting part comprises a fixed gear meshed with the belt driving gear, a swing gear meshed with the fixed gear, and a floating bracket for supporting the swing gear in such a manner that the swing gear is pivotable about the central axis of the fixed gear thereby allowing the fixed gear to be meshed with or released from the swing gear.

The power disconnection actuating part may comprise a connecting member connected with the floating bracket, and an actuator for actuating the connecting member so that the swing gear fixed to the floating bracket pivots about the central axis.

The connecting member preferably comprises a connecting bar projected from the floating bracket in the axial direction of the fixed gear and having an end bent perpendicularly to the axial direction, a connecting hole formed at the end of the connecting bar in the longitudinal direction, and a connecting pin formed on the actuator and supported in the connecting hole to be movable in the longitudinal direction.

The actuator includes a solenoid which comprises a plunger having a top end formed with the connecting pin, a coil for generating a magnetic force when an electric current is applied to the coil to move the plunger, and an elastic spring for returning the plunger to its original position when no electric current is applied to the coil and thus, no magnetic force is generated.

The image belt may comprise one of an image transfer belt for transferring a toner image from a photoconductor to a recording medium, and a photoconductive belt forming the photoconductor.

According to another aspect of the present invention, an image forming apparatus is provided comprising an image forming unit having at least one photoconductor for forming a toner image, a image transfer belt unit having an image transfer belt for transferring the toner image formed on the photoconductor to a recording medium, an image fixing unit for fixing the toner image transferred to the recording medium, and a driving unit for driving each of the units. The driving unit comprises a driving motor, a belt unit driving part having a belt driving gear connected to the driving motor to drive an image belt, an image fixing unit driving part having an image fixing gear for driving an image fixing roller for fixing a toner image onto a recording medium, a power disconnecting part for transmitting the power of the driving motor of the belt unit driving part to the image fixing unit driving part or alternately, for disconnecting the power transmission from the image fixing unit driving part, and a power disconnection actuating part for actuating the power disconnecting part.

The image fixing unit driving part may further comprise a unidirectional power transmission part arranged in such a way that a force applied when the recording medium is pulled in the paper-discharge direction is not transmitted from the image fixing unit driving part to the driving motor. The unidirectional power transmission part is provided at one of a plurality of gears of the image fixing unit driving part, the one gear having a first gear section and a second gear section. The unidirectional power transmission part comprises a swivel boss projected from one side of the first gear section, a first latch gear formed on the one side of the first gear section, a fixed boss projected from one side of the second gear section opposite to the one side of the first gear section and pivotably fixing and supporting the swivel boss, and a second latch gear formed on the one side of the second gear section. The first latch gear and the second latch gear are arranged in such a way that when one of the first and second latch gears rotates in one direction, the first latch gear and the second latch gear are meshed with one another so that power transmission from the one side to the other of the first and second latch gears is connected. The first latch gear and the second latch gear are further arranged in such a way that when the one of the first and second latch gears rotates in the opposite direction, the first latch gear and the second latch gear pass freely over each other so that power transmission from the one side to the other of the first and second latch gears is disconnected.

The power disconnecting part may comprise a fixed gear meshed with the belt driving gear, a swing gear meshed with the fixed gear, and a floating bracket for supporting the swing gear in such a manner that the swing gear is pivotable about the central axis of the fixed gear thereby allowing the fixed gear to be meshed with or released from the swing gear.

The power disconnection actuating part may comprise a connecting member connected with the floating bracket, and an actuator for actuating the connecting member.

The connecting member preferably comprises a connecting bar projected from the floating bracket in the axial direction of the fixed gear and having an end bent perpendicularly to the axial direction, a connecting hole formed at the end of the connecting bar in the longitudinal direction, and a connecting pin formed on the actuator and supported in the connecting hole to be movable in the longitudinal direction.

In addition, the actuator includes a solenoid which comprises a plunger having a top end formed with the connecting pin, a coil for generating a magnetic force when an electric current is applied to the coil to move the plunger, and an elastic spring for returning the plunger to its original position when no electric current is applied to the coil and thus, no magnetic force is generated.

According to still another aspect of the present invention, a method of driving an image forming apparatus is provided comprising the steps of driving a driving motor to form a toner image on a recording medium, detecting a jam of the recording medium while the toner image is being formed on the recording medium, disconnecting the transmission of the power of the driving motor of a belt unit driving part to an image fixing unit driving part, cleaning the toner image formed on an image transfer belt of a belt unit, and stopping the driving motor to place the motor in standby.

It is preferable that the step of detecting the jam of the recording medium further comprises the step of outwardly displaying the jammed state.

It is also preferable that the step of disconnecting the transmission of the power of the driving motor comprises the step of turning an actuator ON to separate a swing gear of a power disconnecting part from a belt driving gear of the belt unit driving part, in which the power disconnecting part serves to transmit the power of the driving motor of the belt unit driving part to the image fixing unit or to disconnect the power of the driving motor from the belt unit driving part from the image fixing unit.

BRIEF DESCRIPTION OF THE DRAWINGS

The above aspects and features of the present invention will become more apparent from the description of exemplary embodiments of the present invention taken in conjunction with the accompanying drawings, in which.

Throughout the drawings, like reference numerals will be understood to refer to like parts, components and structures.

DETAILED DESCRIPTION OF THE EXEMPLARY EMBODIMENTS

Hereinbelow, certain exemplary embodiments of the present invention will be described in greater detail with reference to the accompanying drawings.

The matters defined in the description, such as detailed arrangement and element descriptions, are provided to assist in a comprehensive understanding of the invention. Also, functions or arrangements well known to those skilled in the art are omitted for clarity and conciseness.

Figure 3:
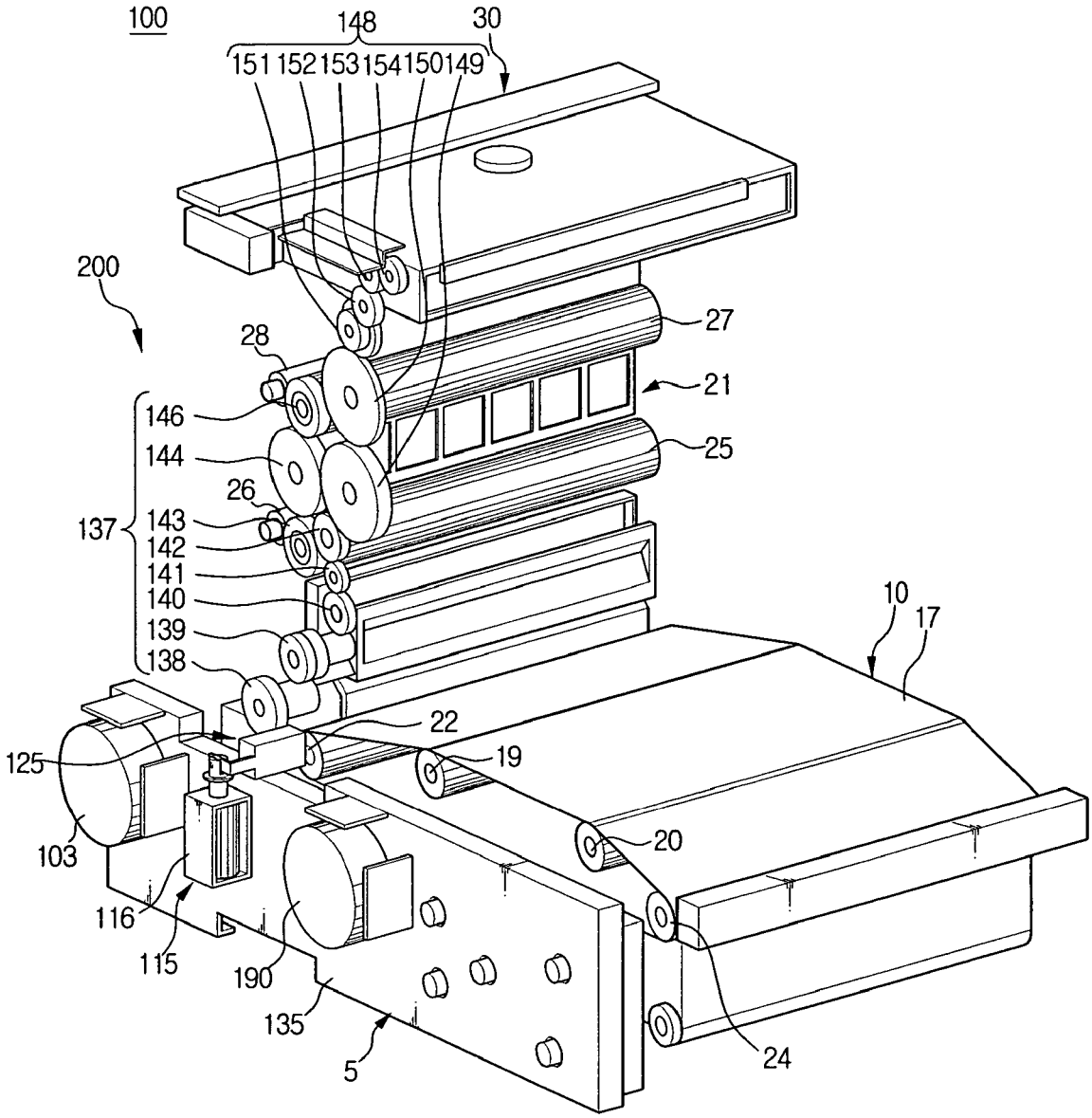
FIG. 3 is a partial perspective view of a wet-type electrophotographic printer with a driving apparatus having a power disconnecting part according to an embodiment of the present invention.
Figure 4:
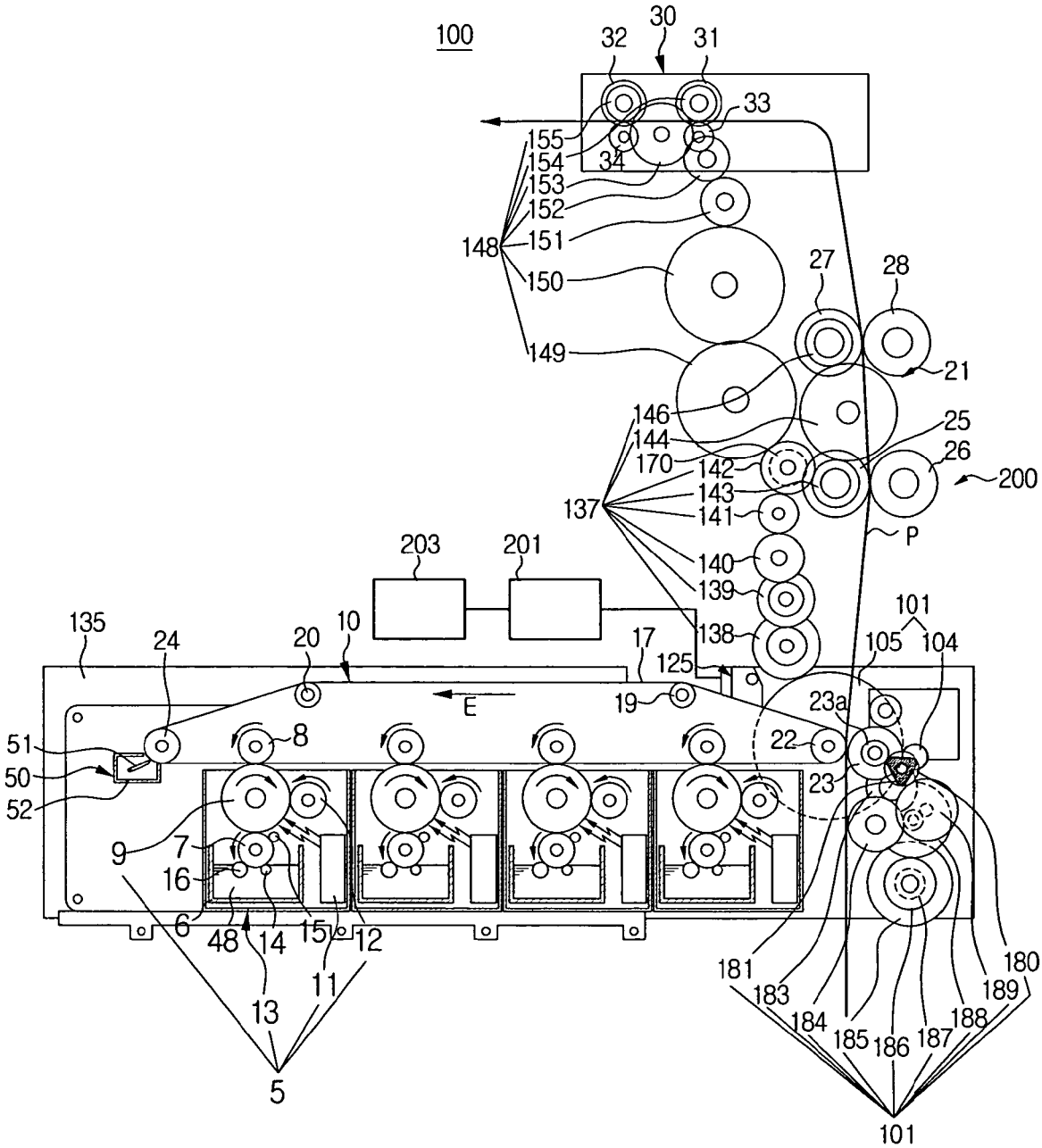
FIG. 4 is a side elevational view of the wet-type electrophotographic printer shown in FIG. 3.

FIGS. 3 and 4 schematically show an image forming apparatus, to which a driving apparatus having a power disconnecting part according to an embodiment of the present invention is applied.

The image forming apparatus including a driving apparatus with a power disconnecting part according to an embodiment of the present invention, is comprised of a wet-type electrophotographic color printer 100 for implementing print by internally processing print data transmitted from a computer (not shown), host device (not shown), or the like.

As shown in FIGS. 3 and 4, the wet-type electrophotographic color printer 100 comprises a paper-feeding unit (not shown) for feeding recording mediums loaded in a paper-feeding cassette (not shown), an image forming unit 5 having four photoconductors 9 for forming toner images, an image transfer belt unit 10 having an image transfer belt 17 with an image forming surface for sequentially transferring toner images formed by the respective photoconductors 9 to a recording medium P such as a recording paper, an image fixing unit 21 having first and second heating rollers 25 and 27 and first and second compressing rollers 26 and 28 as image fixing rollers for fixing the toner images transferred to the recording medium P, a paper discharge unit 30 for discharging the image-fixed recording medium P out of the printer 100, a cleaning unit 50 for cleaning toner images remaining on the image transfer belt 17 after the toner images are transferred to the recording medium P, and a driving apparatus 200 for driving the above-described respective units.

Figure 1:
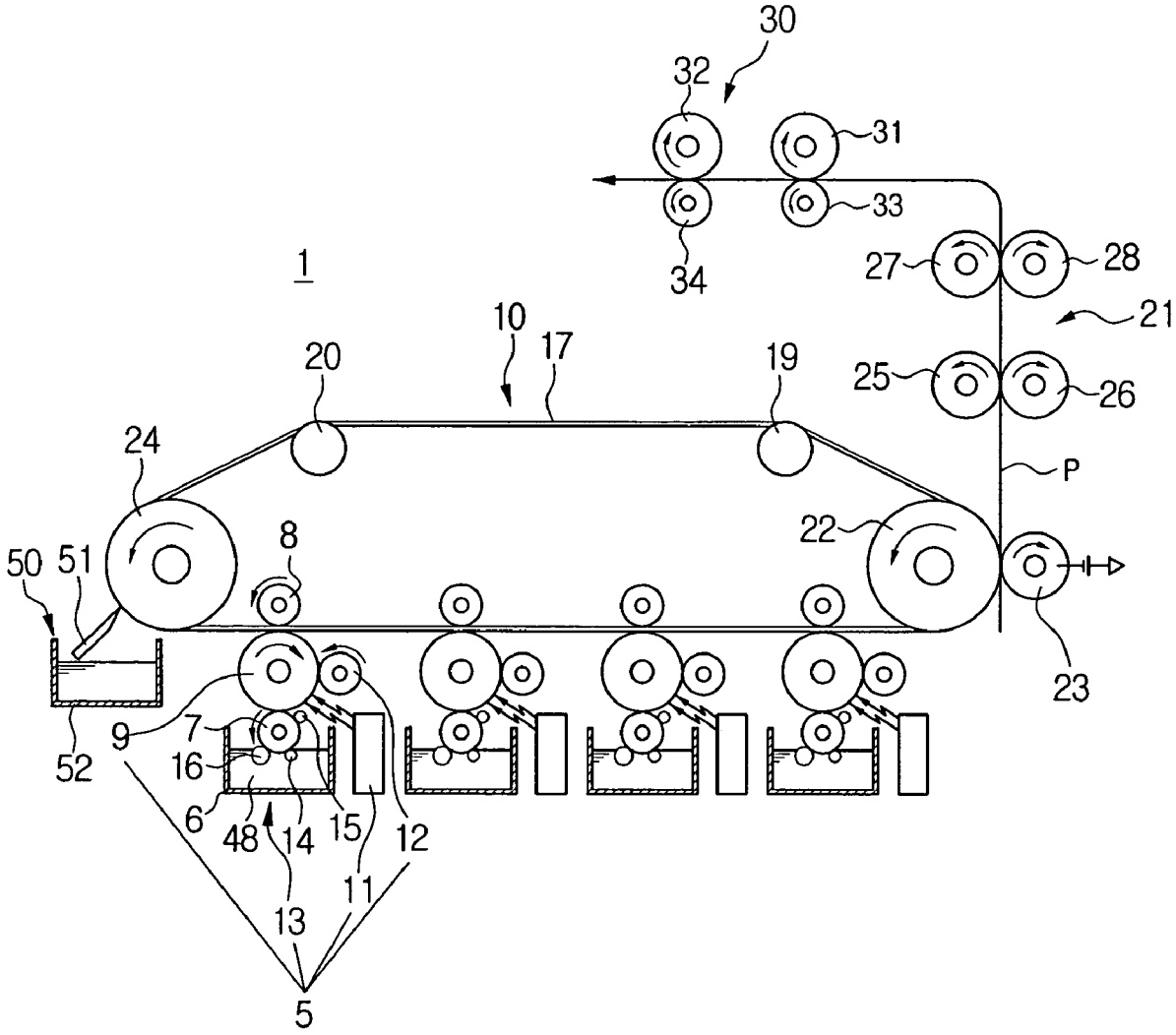
FIG. 1 (PRIOR ART)
FIG. 1 is a schematic view of a conventional wet-type electrophotographic printer.
Figure 2:
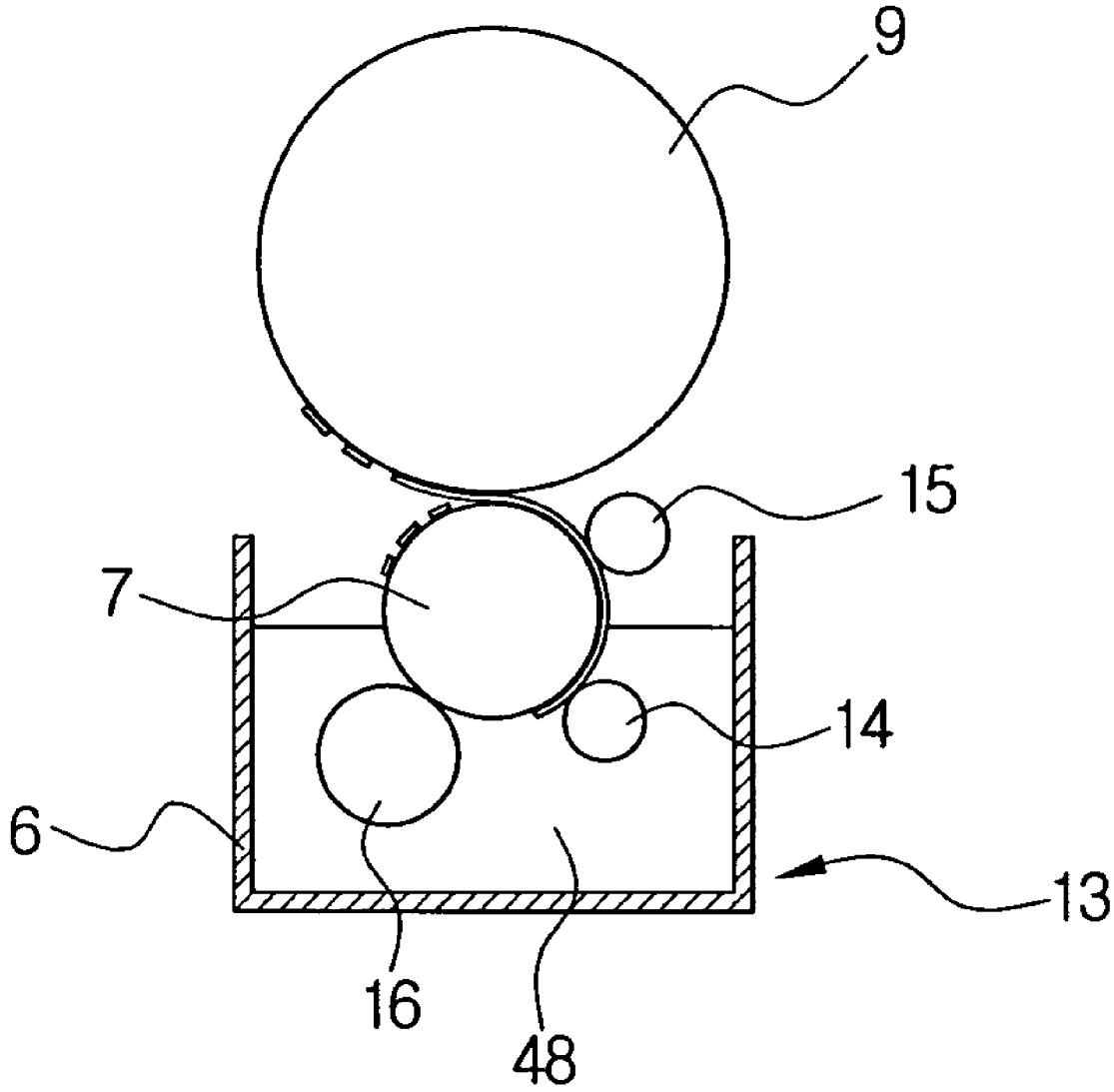
FIG. 2 (PRIOR ART)
FIG. 2 is a schematic view exemplifying a developing device and a photoconductor shown in FIG. 1.

With the exception of the driving apparatus 200, the construction and operation of the wet-type electrophotographic color printer 100 is substantially the same as the conventional electrophotographic color printer 1 described above with reference to FIGS. 1 and 2 or other well-known printers, and thus, a detailed description thereof is omitted.

The driving apparatus 200 according to an embodiment of the present invention comprises a paper-feeding unit driving part (not shown), an image forming unit driving part (not shown), an image transfer belt driving part 101, an image fixing unit driving part 137, a paper-discharge unit driving part 148, a power disconnecting part 125, a power disconnection actuating part 115, and a controller 201 for controlling each of the components of the driving apparatus 200.

The paper-feeding unit driving part comprises a first driving motor (not shown) for the paper-feeding unit, and a paper-feeding gear train (not shown) connected to the first driving motor to drive a pick-up roller (not shown) and a paper feeding roller (not shown). The paper-feeding gear train has a construction that is well known to those skilled in the art, therefore, a detailed description thereof is omitted.

The image forming unit driving part comprises a second driving motor 190 for image-forming, an image forming gear train (not shown) driven by the second driving motor 190 and driving the respective photoconductors 9, a developing roller 7, a deposit roller 14, and a metering roller 15, of each of the developing apparatus' 13. The image forming gear train has a construction that is also well-known to those skilled in the art, therefore, a detailed description thereof is omitted.

The image belt unit driving part 101 serves to drive the image transfer belt unit 10, and comprises a third driving motor 103 for image transfer and fixing, a belt driving gear 105, a clutch reduction gear 183, a first idle gear 184, a first clutch gear 185, a clutch 187, a second clutch gear 186, a first reduction gear 188, a second reduction gear 189, a cam driving gear 180, and a cam 181.

The belt driving gear 105 is connected to one side of the driving gear 104 of the third driving motor 103. The power transmitted to the belt driving gear 105 is transmitted to the image transfer belt 17 through the belt driving roller 22, as a result of which, the image transfer belt 17 is rotated in the direction indicated by the arrow E as shown in FIG. 4 along the first, second, and third rollers 19, 20, and 24.

The clutch reduction gear 183, connected to the other side of the driving gear 104, is connected to the first clutch gear 185 through the first idle gear 184 and transmits the power of the third driving motor 103 to the first clutch gear 185. The power of the third driving motor 103, transmitted to the first clutch gear 185, is either transmitted to the second clutch gear 186 or disconnected by the clutch 187. The clutch 187 transmits the power of the third driving motor 103 to the second clutch gear 186 when it is required. The second image transfer roller 23 can then be placed in contact with the image transfer belt 17 for secondarily transferring the toner images, primarily transferred to the image transfer belt 17 from the respective photoconductors 9, onto the recording medium P, and can be spaced apart from the image transfer belt 17 after the secondary image transfer is terminated. The power of the third driving motor 103, transmitted to the second clutch gear 186, is transmitted to the cam driving gear 180 through the first and second reduction gears 188 and 189. The cam 181 is arranged to be coaxial with the cam driving gear 180 and has a triangular shape, wherein the cam 181 pushes or retracts a shaft 23*a* of the second image transfer roller 23 supported by an elastic spring (not shown) as the cam driving gear 180 rotates, thereby urging the second image transfer roller 23 to come into contact with or to be spaced apart from the belt driving roller 22. When the second image transfer roller 23 comes into contact with the image transfer roller 22 as urged by the cam 181 and the image transfer belt 17 is rotated by the belt driving roller 22, the second image transfer roller 23, which compresses a recording medium P against the image transfer belt 17, is rotated in one direction, for example, clockwise as shown in FIG. 4. The rotation of the transfer roller 23 is in cooperation with the image transfer belt 17, thereby transferring the recording medium P in cooperation with the image transfer belt 17.

The image fixing unit driving part 137 serves to drive the image fixing unit 21 and comprises third and fourth reduction gears 138 and 139, second and third idle gears 140 and 141, a first sun gear 142, a first heating roller gear 143, a fifth idle gear 144, and a second heating roller gear 146. The third reduction gear 138 is connected to the belt driving gear 105 through a power disconnecting part 125, described in greater detail below, and transmits the power of the third driving motor 103 to the first sun gear 142 through the fourth reduction gear 139 and the second and third idle gears 140 and 141. The first sun gear 142 is connected at one side thereof (that is, the right side in FIG. 4), with the first heating roller gear 143 coaxially formed at one end of the shaft of the first heating roller 25. Thus, when the first heating roller gear 143 is rotated by the first sun gear 142, the first heating roller 25 arranged to be coaxial with the first heating roller gear 143 is rotated in the opposite direction, that is, counterclockwise as shown in FIG. 4. The result of the counterclockwise rotation of the first heating roller gear 143 is that the first compressing roller 26 compressing the recording medium P against the first heating roller 25 is rotated clockwise as shown in FIG. 4 in cooperation with the first heating roller 25, thereby transferring the recording medium P.

The first heating roller gear 143 is connected with the second heating roller gear 146 coaxially formed at one end of the shaft of the second heating roller 27 through the fifth idle gear 144. Accordingly, the second heating roller 27, arranged to be coaxial with the second heating roller gear 146, is rotated in the opposite direction, that is, counterclockwise as shown in FIG. 4. The result of the counterclockwise rotation of the second heating roller gear 146 is that the second compressing roller 28 compressing the recording medium P against the second heating roller 27 is rotated clockwise as shown in FIG. 4 in cooperation with the second heating roller 27, thereby transferring the recording medium P.

Figure 5:
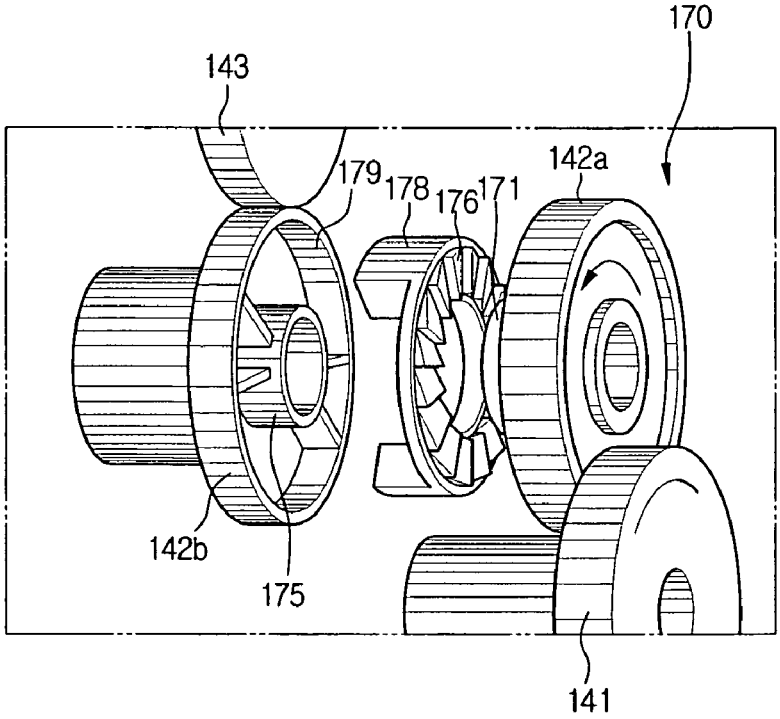
FIGS. 5 and 6 are partial left and right side perspective views exemplifying a unidirectional power transmission of an image fixing unit driving part of the driving apparatus of the wet-type electrophotographic printer shown in FIG. 3, respectively.
Figure 6:
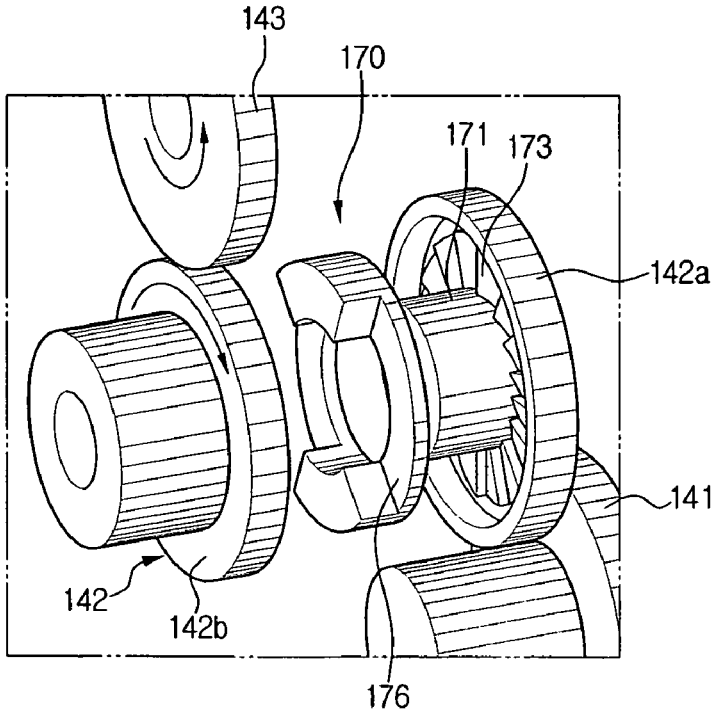

As shown in FIGS. 5 and 6, the image fixing unit driving part 137 may further comprise a unidirectional power transmission part 170 so as to provide a simple and easy means to remove a jam when a jam of the recording medium P occurs in the image fixing unit 21.

The unidirectional power transmission part 170 is located between the first gear section 142*a* and a second gear section 142*b* of the first sun gear 142, wherein the first gear section 142*a* is meshed with the third idle gear 141 and the second gear section is meshed with the first heating roller gear 143.

The unidirectional power transmission part 170 comprises a swivel boss 171, a first latch gear 173, a fixed boss 175, and a second latch gear 176. The swivel boss 171 and the first latch gear 173 are provided on one side of the first gear section 142*a*, and the fixed boss 175 and the second latch gear 176 are provided at one side of the second gear section 142*b* opposite to the first gear section 142*a*. The swivel boss 171 is rotatably secured to the fixed boss 175 of the second gear section 142*b*. The second latch gear 176 is rotatably supported within a predetermined range of angles in a bracket reception recess 179 by the fixed bracket 178.

The first latch gear 173 and the second latch gear 176 are configured in such a way that they are engaged with each other and perform unidirectional power transmission, for example, from the first latch gear 173 to the second latch gear 176, when the first gear section 142*a* is rotated in one direction, for example, clockwise as shown in FIG. 4. In doing so, the first latch gear 173 and the second latch gear 176 pass freely over each other and thus, the power transmission from the first latch gear 173 to the second latch gear 176 is disconnected unlike when the first gear section 142*a* is rotated in the opposite direction, that is, counterclockwise as shown in FIG. 4. When the second gear section 142*b* is rotated in one direction, for example, clockwise as shown in FIG. 4, the first latch gear 173 and the second latch gear 176 also pass freely over each other and thus, the power transmission from the second latch gear 176 to the first latch gear 173 is disconnected. When the second gear section 142*b* is rotated in the opposite direction, that is, counterclockwise as shown in FIG. 4, the first latch gear 173 and the second latch gear 176 are engaged with each other and the power transmission is connected from the second latch gear 176 to the first latch gear 173.

Accordingly, when the first sun gear 142 is rotated clockwise as shown in FIG. 4, the power of the driving motor is normally transmitted to the first heating roller gear 143 by the first and second latch gears 173 and 176.

In addition, if a recording medium P is jammed between the first heating roller 25 and/or the second heating roller 27 and the first compressing roller 26 and/or the second compressing roller 28 as the recording medium P is caught or slipped during image formation, a force for removing the jam that is applied when the user pulls the recording medium P by hand is transmitted to the first sun gear 142 through the first and/or second heating roller 25 and/or 27. However, because the second gear section 142*b* is rotated clockwise as shown in FIG. 4, the force is not transmitted to the fourth gear 138 and the image transfer belt gear 105 through the first and second latch gears 173 and 176. Accordingly, it is possible to prevent the recording medium P from being torn or seriously damaged by the load of the third driving motor 103 when the force for removing the jam is transmitted to the driving motor through the first and second heating rollers 25 and 27 and the belt driving roller 22.

Although the unidirectional power transmission part 170 has been described as being provided in the first sun gear 142, the present invention is not limited to this embodiment. In yet other embodiments of the present invention, it is possible to provide the unidirectional power transmission part 170 at another type of gear, for example, at any one of the gears of the image fixing unit driving part 137.

The paper-discharge unit driving part 148 serves to drive the paper-discharge unit 30, and comprises sixth, seventh, eighth, and ninth idle gears 149, 150, 151, and 152, respectively, a second sun gear 153, and first and second paper-discharge roller gears 154 and 155. The ninth idle gear 149 is connected to the other side of the first sun gear 142, that is, the left side of the first sun gear 142 as shown in FIG. 4, and is connected to the second sun gear 153 through the seventh, eighth, and ninth, idle gears 150, 151, and 152. The second sun gear 153 is connected with the first and second paper-discharge roller gears 154 and 155, coaxially formed at one end of the shafts of the first and second paper-discharge rollers 31 and 32, respectively. Accordingly, when the second sun gear 153 is rotated in the opposite direction, that is, counterclockwise as shown in FIG. 4, the first and second paper-discharge rollers 31 and 32, formed to be coaxial with the first and second paper-discharge roller gears 154 and 155, are rotated clockwise by the second sun gear 153. As a result, the first and second paper-discharge backup rollers 33 and 34, compressing a recording medium P against the first and second paper-discharge rollers 31 and 32 with a predetermined pressure, discharge the recording medium P in cooperation with the first and second paper-discharge rollers 31 and 32.

The power disconnecting part 125 serves to transmit or disconnect the power of the third driving motor 103 from the transfer belt unit driving part 101 to the image fixing unit driving part 137, wherein the power disconnecting part 125 is provided between the belt driving gear 105 and the third reduction gear 138.

Figure 7:
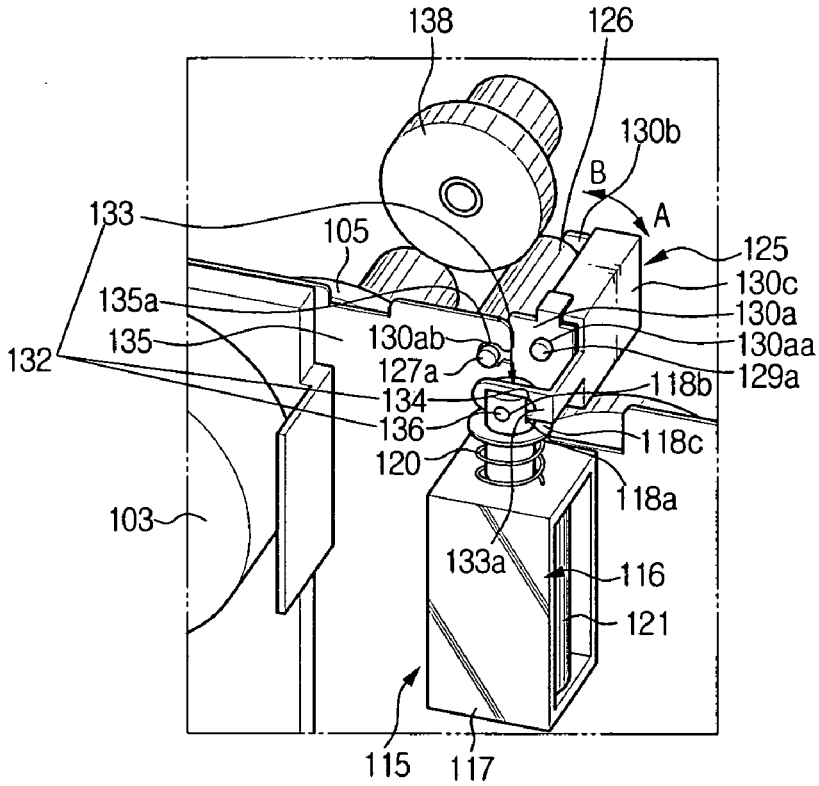
FIGS. 7 and 8 are partial left and right side perspective views exemplifying a power disconnecting part and a power disconnection actuating part of the driving apparatus of the wet-type electrophotographic printer shown in FIG. 3, respectively.
Figure 8:
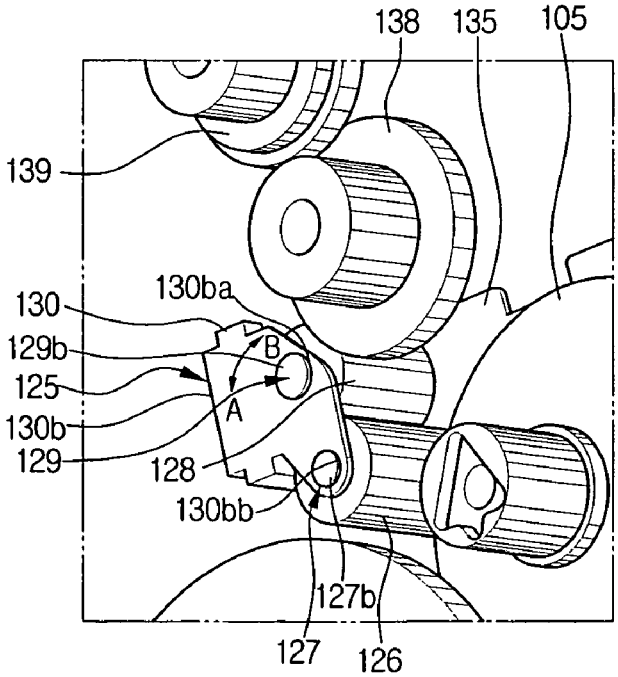

As shown in FIGS. 7 and 8, the power disconnecting part 125 comprises a fixed gear 126, a swing gear 128, and a floating bracket 130.

As shown in FIGS. 7 and 8, the fixed gear 126 is meshed with the belt driving gear 105, and is arranged to be coaxial with the fixed shaft 127. The fixed shaft 127 has a first end 127*a* that is rotatably supported in a fixing hole 135*a* of a main frame 135, to which, the image transfer belt unit 10 is secured.

The swing gear 128 is meshed with the fixed gear 126 and is arranged to be coaxial with the floating shaft 129. The floating shaft 129 has first and second ends 129*a* and 129*b*, respectively, that are rotatably supported by the floating bracket 130.

The floating bracket 130 is formed in a "C" shape and comprises first and second side walls 130*a* and 130*b*, respectively, and a connection plate 130*c*. The first and second side walls 130*a* and 130*b* are formed with first and second floating shaft holes 130*aa* and 130*ba* for rotatably receiving and supporting the first and second ends 129*a* and 129*b* of the floating shaft 129, respectively, and first and second fixing shaft holes 130*ab* and 130*bb* for rotatably receiving and supporting the first and second ends 127*a* and 127*b* of the fixed shaft 127, respectively.

Accordingly, when the floating bracket 130 rotates in the direction indicated by the double arrow A-B of FIGS. 7 and 8 about the fixed shaft 127, the swing gear 128 can be meshed with the third reduction gear 138 of the image fixing unit driving part 137 or can be released from the third reduction gear 138, so that the power of the third driving motor 103 can be connected and transmitted from the belt unit driving part 101 to the image fixing unit driving part 137 or disconnected from the image fixing unit driving part 137.

The power disconnection actuating part 115 serves to actuate the power disconnecting part 125, wherein the power disconnection actuating part 115 is mounted on the main frame 135 in the vicinity of the floating bracket 130.

The power disconnection actuating part 115 comprises a connecting member 132 and an actuator 116.

The connecting member 132 comprises a connecting bar 133, a connecting hole 134 and a connecting pin 136. The connecting bar 133 which projects in the axial direction of the fixed shaft 127 beyond the floating bracket 130 in the vicinity of the first floating shaft hole 130*aa* of the first side wall 130*a* of the floating bracket 130, has an end 133*a* that is bent perpendicularly to the axial direction of the fixed shaft 127. The connecting hole 134 is formed at the end 133*a* of the connecting bar 133 and is elongated in a longitudinal direction. The connecting pin 136 is inserted and supported in a fixing hole 118*b* formed at the top end of a plunger 118 of the actuator 116, described in greater detail below, wherein the connecting pin 136 is arranged to span a beeline groove 118*a* and pass through the elongated connecting hole 134.

The actuator 116 comprises a solenoid for actuating the connecting bar 133 of the connecting member 132, so that the floating bracket 130 is pivoted about the fixed shaft 127.

Figure 9:
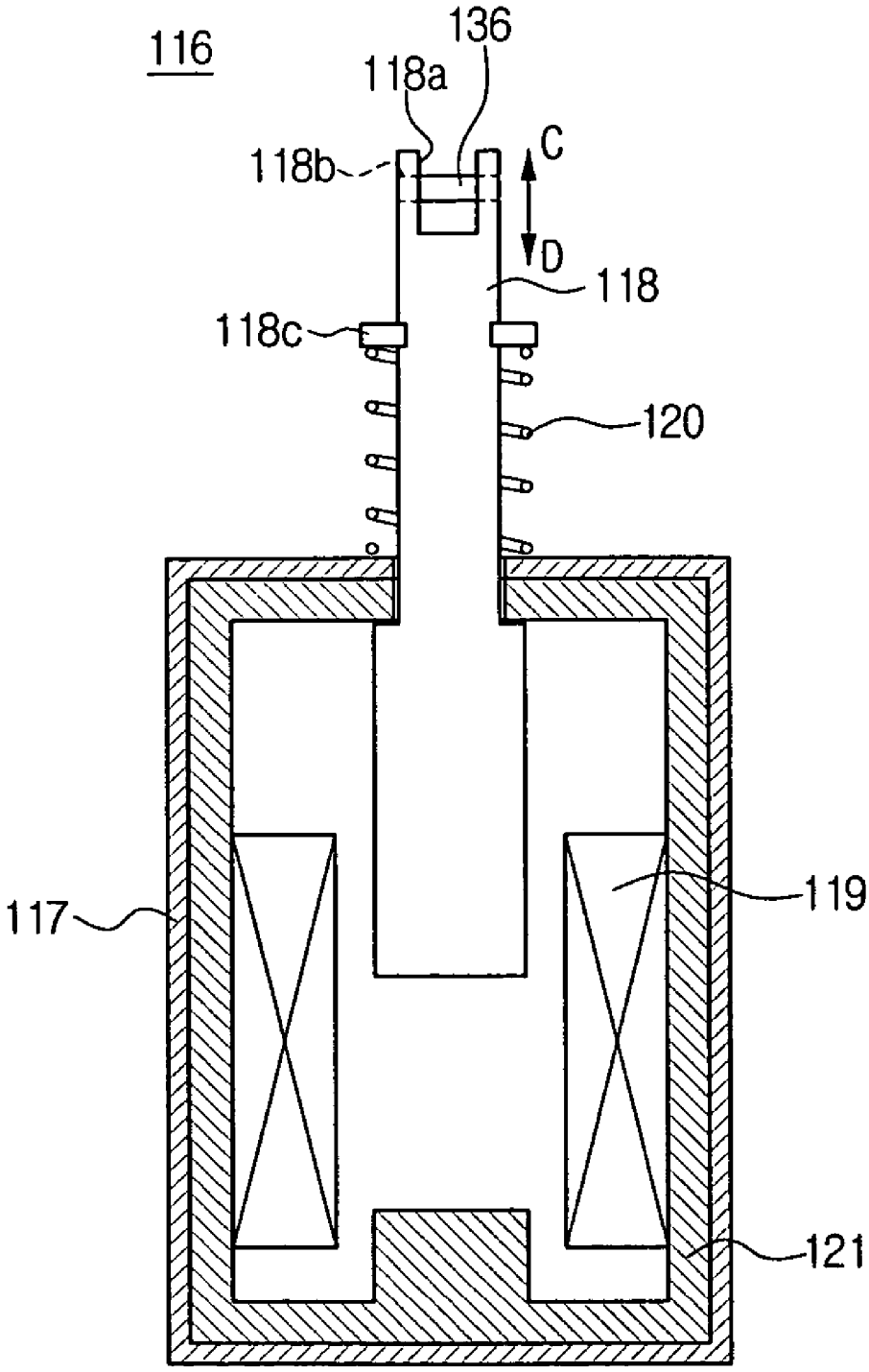
FIG. 9 is a cross-sectional view of a solenoid of the power disconnecting actuating part shown in FIG. 7.
Figure 10:
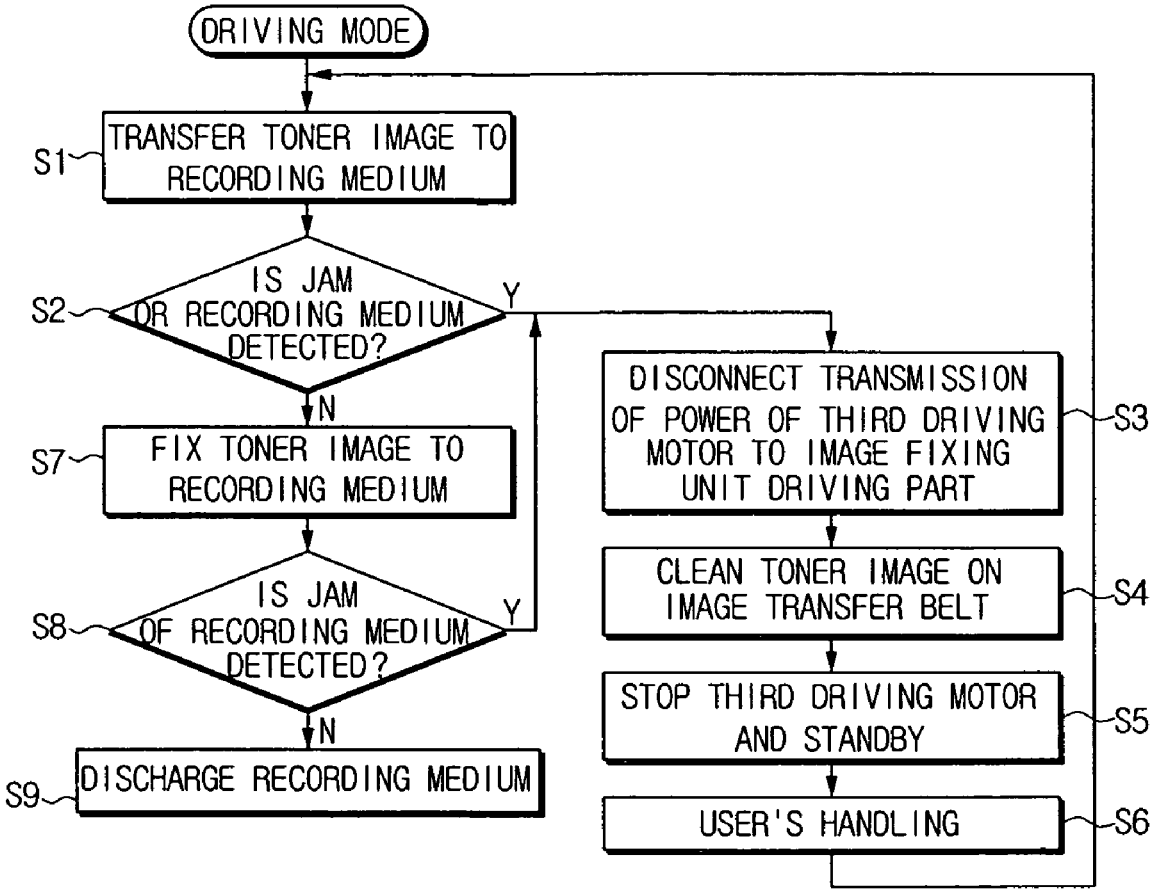
FIG. 10 is a flowchart exemplifying a process for driving the wet-type electrophotographic printer shown in FIG. 3 according to an embodiment of the present invention.

As shown in FIG. 9, the actuator 116 comprises a plunger 118, a coil 119, an elastic spring 120, and a case 117.

The plunger 118 is formed from a metallic material activated by a magnetic force or a magnetic material, and has a fixing hole 118*b* at one end thereof, through which the connecting pin 136 is anchored, and a beeline groove 118*a*.

The coil 119 generates a magnetic force when an electric current is applied to the coil 119 and pulls the plunger 118, whereby the plunger 118 is downwardly moved in the direction indicated by the arrow D as shown in FIG. 9. The coil 119 is supported by a yoke 121 in the case 117.

The elastic spring 120 serves to return the plunger 118 upwardly in the direction indicated by the arrow C as shown in FIG. 9 to its original position when no current is applied to the coil 119, and thus, no magnetic force is generated. The elastic spring 120 is interposed between a washer 118*c* of the plunger 118 and the top surface of the case 117.

Accordingly, when the actuator 116 is turned ON, that is, when an electric current is applied to the coil 119, the plunger 118 is lowered, thereby causing the floating bracket 130 to pivot in the direction indicated by the arrow A of FIGS. 7 and 8 about the fixed shaft 127 through the connecting member 132. The result of pivoting the floating bracket 130 about the fixed shaft 127 in this manner is that the swing gear 128 secured to the floating bracket 130 is released from the third reduction gear 138 of the image fixing unit driving part 137, thereby disconnecting the transmission of the power of the third driving motor 103 of the image transfer belt unit driving part 101 from the image fixing unit driving part 137.

In addition, when the actuator 116 is turned OFF, that is, when no electric current is applied to the coil 119, the plunger 118 is lifted by the elastic spring 120, thereby causing the floating bracket 130 to pivot in the direction indicated by the arrow B of FIGS. 7 and 8 about the fixed shaft 127 through the connecting member 132. The result of pivoting the floating bracket 130 about the fixed shaft 127 in this manner is that the swing gear 128 secured to the floating bracket 130 is engaged with the third reduction member 138 of the image fixing unit driving part 137 and transmits the power of the third driving motor 103 of the image transfer belt unit driving part 101 to the image fixing unit driving part 137.

The controller 201 controls the operations of some or all of the respective units described above, including the third and second driving motors 103 and 190, for example, the voltage supply to the charging rollers 12, the laser scanning units 11, and the first and second image transfer rollers 8 and 23. The controller 201 further senses a jam of a recording medium P, and controls the operation of the actuator 116 of the power disconnection actuating part.

If a second medium detection sensor (not shown) positioned in front of the image fixing unit 21, and/or a third medium detection sensor (not shown) positioned in front of the paper-discharge unit 30, are not activated until a predetermined length of time has passed after a first medium detection sensor (not shown) positioned at the paper-feeding unit is activated by the recording medium P, the controller 201 judges that the recording medium P is in a jammed state. If the second and third medium detection sensors are activated within a predetermined length of time, the controller 201 judges that the recording medium P is in a normal state. If it is judged that the recording medium P is jammed, the controller 201 displays the jammed state through a display 203 of a control panel (not shown).

In the above exemplary embodiment of the present invention, the power disconnecting part 125 and the power disconnection actuating part 115 of the driving apparatus 200 have been described as being applied to allow the removal of toner images remaining on the image transfer belt 17 at the time of a jam in the wet-type electrophotographic printer 100 having the image transfer belt unit 10 with the image transfer belt 17 for transferring the toner images formed on the respective photoconductors 9, and having the image fixing unit 21 for fixing the toner images transferred onto a recording medium P. However, the present invention is not limited to this exemplary embodiment and is applicable to other types of wet-type printers. For example, in yet other embodiments of the present invention the power disconnecting part 125 and the power disconnection actuating part 115 of the exemplary driving apparatus 200 are applicable to a printer including an image fixing unit (not shown) or an image transfer/image fixing unit (not shown) which uses a photoconductive belt (not shown) rather than an OPC drum as a photoconductor 9 and which directly transfers and fixes toner images to a recording medium P from the photoconductive belt unit 10 without using an image transfer belt 17, so as to remove the toner images remaining on the photoconductive belt when a jam occurs.

In addition, although the image fixing unit 21 of the exemplary wet-type electrophotographic color printer 100 has been described as employing the first and second heating rollers 25 and 27 for the image fixing rollers heating function, and the first and second compressing rollers 26 and 28 for the image fixing rollers compressing function, the present invention is not limited to this and can employ other types and numbers of image fixing rollers, for example, two or more rollers having both heating and compressing functions without division of those functions.

An exemplary method of driving the wet-type electrophotographic color printer 100 having a driving apparatus 200 with a power disconnecting part 125 according to an embodiment of the present invention configured as described above is now described in greater detail with reference to FIGS. 3 to 10.

At first, as a print command is applied, the controller 201 drives the first, second and third driving motors.

As a result, a recording medium P, loaded in the paper-feeding cassette (not shown), is transferred between the image transfer belt 17 of the image transfer belt unit 10 and the second image transfer roller 23 by the pickup rollers (not shown) and the paper-feeding rollers (not shown) of the paper-feeding unit driven by the paper-feeding gear train.

In addition, the image forming gear train of the image forming unit driving part drives the respective photoconductors 9, the developing rollers 7, the deposit rollers 14, and the metering rollers 15 of the respective developing apparatuses 13. As a result, the electrostatic latent images are formed on the respective photoconductors 9 by the respective deposit rollers 12 and the scanning units 11, and are sequentially developed into an image of four colors of yellow, magenta, cyan, and black by liquid developers 48. The toner images formed on the respective photoconductors 9 are primarily transferred from the photoconductors 9 to the image transfer belt 17 by the voltage and pressure of the first image transfer rollers 8 located inside of the image transfer belt 17.

In addition, the clutch 187 of the image transfer belt unit driving part 101 is turned ON and transmits the power of the third driving motor 103 to the second clutch gear 186. As a result, the power of the third driving motor 103, transmitted to the second clutch gear 186, is transmitted to the cam driving gear 180 through the first reduction gear 188 and the second reduction gear 189. The cam 181 pushes the shaft 23*a* of the second image transfer roller 23, supported by an elastic spring (not shown), so that the second image transfer roller 23 comes into contact with the image transfer belt roller 22.

From this state, when the belt driving gear 105 is rotated in the opposite direction, for example, counterclockwise as shown in FIG. 4 by the driving gear 104 of the third driving motor 103, the belt driving roller 22 arranged to be coaxial with the belt driving gear 105, is also rotated counterclockwise. As a result, the image transfer belt 17 rotates in the direction indicated by the arrow E as shown in FIG. 4 along the first, second, and third support rollers 19, 20, and 24.

Returning to FIG. 10, as the image transfer belt 17 rotates, the toner images transferred to the image transfer belt 17 move to the second image transfer roller 23 as the image transfer belt 17 is rotated by the belt driving roller 22, and are then secondarily transferred to a recording medium P by the voltage and pressure of the second image transfer roller 23 which compresses the recording medium P against the image transfer belt 17 with a predetermined level of pressure at step (S1).

At this time, if a jam occurs between the image transfer belt 17 and the second image transfer roller 23 as the recording medium P is caught or slipped, the second and third medium detection sensors located in front of the image fixing unit 21 and/or the paper-discharge unit 30, respectively, are not activated until a predetermined length of time has passed from the time when the first medium detection sensor located at the paper-feeding unit was activated by the recording medium P, and thus, the controller 201 detects the jam of the recording medium P at step (S2).

Upon detecting the jam of the recording medium P, the controller 201 disconnects the power supply to the first driving motor, the laser scanning unit 11, and the first and second image transfer rollers 8 and 23 of the image forming unit 5, while displaying the jammed state through the display 203 of the control panel. The controller 201 then turns the actuator 116 ON. As the actuator 116 is turned ON, an electric current is applied to the coil 119. Consequently, the plunger 118 is downwardly lowered by the magnetic force produced by the coil 119, thus causing the floating bracket 130 to pivot in the direction indicated by the arrow A as shown in FIGS. 7 and 8 about the fixed shaft 127 through the connecting member 132. Accordingly, the swing gear 128, secured to the floating bracket 130, is released from the third reduction gear 138, thereby disconnecting the transmission of the power of the third driving motor 103 of the image transfer belt unit driving part 101 from the image fixing unit driving part 137 at step (S3).

At this time, since the third driving motor 103 is being continuously driven, the power of the third driving motor 103 is continuously transmitted to the belt driving gear 105, and the belt driving roller 22 arranged to be coaxial with the belt driving gear 105 rotates counterclockwise. As a result, the image transfer belt 17 continuously rotates along the first, second, and third support rollers 19, 20, and 24 to the cleaning blade 51 arranged to be in contact with the image forming surface of the image transfer belt 17 at a side of the third support roller 24, where a toner image remaining on the surface of the image transfer belt 17 that has not been transferred to the recording medium P due to the jam is cleaned at step (S4).

After the toner image is cleaned for a predetermined length of time, for example, during about one revolution of the image transfer belt 17 in this manner, the controller 201 turns the actuator 116 OFF so that the plunger 118 is returned to its original position to allow the swing gear 128 to be meshed with the third reduction gear 138, discontinues the operations of the second and third driving motors 103 and 190, and then enters a standby mode to await the user's response at step (S5).

Once the user reads the provided message for the jammed state displayed on the display 203 of the control panel, the user can take the necessary measures or demand a service call for removing the jam at step (S6). Accordingly, even if a jam occurs between the image transfer belt 17 and the second image transfer belt 23 at the time of secondary image transfer of the image transfer belt 17, it is possible to prevent the toner adhesion and solidification problems occurring when a toner image is left on the image transfer belt 17 without being transferred to a recording medium P as the printer stands idle.

At step (S2), if the recording medium P is not jammed between the image transfer belt 17 and the second image transfer roller 23, the power of the third driving motor 103 transmitted to the third reduction gear 138, is transmitted to the first heating roller gear 143 through the fourth reduction gear 139, the second and third idle gears 130 and 141, the first gear section 142*a* of the first sun gear 142, the unidirectional power transmission part 170, and the second gear section 142*b* of the first sun gear 142. At this time, since the first gear section 142*a* rotates clockwise as shown in FIG. 4, the first latch gear 173 and the second latch gear 176 of the unidirectional power transmission part 170 are engaged with each other. Accordingly, the power of the third driving motor 103 is transmitted from the first gear section 142*a* to the second gear section 142*b*.

The power transmitted to the first sun gear 142 is in turn transmitted to the first heating roller gear 143. Consequently, the first heating roller 25 formed to be coaxial with the first heating roller gear 143, rotates counterclockwise as shown in FIG. 4. Accordingly, the first compressing roller 26 for compressing a recording medium P against the first heating roller 25 transfers the recording medium in the paper-discharge direction while primarily fixing the toner image formed on the recording medium P with heat and pressure in cooperation with the first heating roller 25 at step (S7).

In addition, the power of the driving motor 103 transmitted to the first heating roller gear 143, is transmitted to the second heating roller gear 146 through the fifth idle gear 144, such that the second heating roller 27 and the second compressing roller 28 transfer the recording medium P in the paper-discharge direction while secondarily fixing the toner image formed on the recording medium P with heat and pressure.

At this time, if the recording medium P is jammed between the first heating roller 25 and/or the second heating roller 27 and the first compressing roller 26 and/or the second compressing roller 28 as the recording medium P is caught or slipped, the controller 201 detects the jam of the recording medium P through the third medium detection sensor at step (S8), and operates the actuator 116 at step (S3) after a predetermined length of time has passed as in the case in which the jam occurs between the image transfer belt 17 and the second image transfer roller 23. Accordingly, a toner image remaining on the surface of the image transfer belt 17 that has not been transferred to the recording medium P due to the jam is cleaned at step (S4). The controller further discontinues the operation of the second and third driving motor 103 and 190 at step (S5), and enters a standby mode to await the user's response. At this time, the toner image remaining on the image transfer belt 17 can be cleaned without worsening the jam between the first and second heating rollers 25 and 27 and the first and second compressing rollers 26 and 28, because the power of the third driving motor 103 is not transmitted to the image fixing unit 21.

Upon reading the provided message for the jammed state displayed on the display 203 of the control panel, the user can take the necessary measures or demand a service call for removing the jam at step (S6). Accordingly, as with the jam occurring at the time of secondary image transfer, it is possible to prevent the toner adhesion and solidification problems occurring as a toner image is left on the image transfer belt 17 without being transferred to the recording medium P as the printer stands idle even if the jam occurs.

At this time, if the user pulls the recording medium P by hand so as to remove the jam, the force applied to remove the jam is not transmitted to the second idle gear 140 due to the first and second latch gears 173 and 176 of the unidirectional power transmission part 170, although the force is transmitted to the first sun gear 142 through the first and second heating rollers 25 and 27 or the first and second compressing rollers 26 and 28. Consequently, it is possible to prevent the recording medium P from being torn or seriously damaged by the load of the third driving motor 103 applied when the force applied to remove the jam is transmitted to the third driving motor 103 through the first and second heating rollers 25 and 27 or the first and second compressing rollers 26 and 28.

Unless the recording medium is jammed between the first and/or second heating rollers 25 and 27 and the first and/or second compressing rollers 26 and 28 of the image fixing unit 21 at step (S8), the power of the third driving motor 103, transmitted to the sixth idle gear 149 from the first sun gear 142, is transmitted to the first and second paper-discharge gears 154 and 155 through the seventh, eighth, and ninth idle gears 150, 151, and 152, and the second sun gear 153. As a result, the first and second paper-discharge rollers 31 and 32 and the first and second paper-discharge backup rollers 33 and 34 compressing the recording medium P against the first and second paper-discharge rollers 31 and 32 discharge the recording medium P out of the printer at step (S9).

As described above, by providing a power disconnecting part for disconnecting the power transmitted to an image fixing unit and/or an image transfer/fixing unit when a paper jam occurs, so that a toner image formed on a image transfer belt or photoconductive belt can be cleaned, the exemplary embodiments of the power disconnecting apparatus and the image forming apparatus having the same can prevent the toner adhesion and solidification problems for the image transfer belt, the cleaning blade, or the photoconductive belt, which is caused when a toner image is left for a long time on the image transfer belt or photoconductive belt as the printer stands idle. As a result, it is possible to remove the toner image remaining on the image transfer belt or photoconductive belt without worsening the jam, as well as prevent damage to the image transfer belt, cleaning blade, photoconductor or photoconductive belt, and deterioration of image quality.

In addition, by being provided with a unidirectional power transmission part which allows easy removal of a jam when such a jam occurs in an image fixing unit, the exemplary embodiments of the power disconnecting apparatus and the image forming apparatus having the same can prevent a recording medium from being torn or seriously damaged at the time of removing the jam.

While embodiments of the present invention have been shown and described in order to exemplify the principles of the present invention, the present invention is not limited to these specific embodiments. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. A driving apparatus for an image forming apparatus, comprising:

a driving motor;

a belt unit driving part having a belt driving gear connected to the driving motor to drive an image belt;

an image fixing unit driving part having an image fixing gear for driving an image fixing roller for fixing a toner image onto a recording medium;

a power disconnecting part for transmitting the power of the driving motor of the belt unit driving part to the image fixing unit driving part and for disconnecting the power transmission of the driving motor from the image fixing unit driving part; and a power disconnection actuating part for actuating the power disconnecting part.

2. The driving apparatus as claimed in claim 1, wherein the image fixing unit driving part further comprises:

a unidirectional power transmission part configured such that a force applied when the recording medium is pulled in the paper-discharge direction is not transmitted from the image fixing unit driving part to the driving motor.

3. The driving apparatus as claimed in claim 2, wherein the unidirectional power transmission part is provided at one of a plurality of gears of the image fixing unit driving part, the one gear having a first gear section and a second gear section, and wherein the unidirectional power transmission part comprises:

a swivel boss projected from one side of the first gear section;

a first latch gear formed on the one side of the first gear section;

a fixed boss projected from one side of the second gear section opposite to the one side of the first gear section and pivotably fixing and supporting the swivel boss; and a second latch gear formed on the one side of the second gear section.

4. The driving apparatus as claimed in claim 3, wherein:

the first latch gear and the second latch gear are configured such that when one of the first and second latch gears rotates in one direction, the first latch gear and the second latch gear are meshed with each other so that power transmission from the one to the other of the first and second latch gears is connected; and when the one of the first and second latch gears rotates in the opposite direction, the first latch gear and the second latch gear pass freely over each other so that power transmission from the one to the other of the first and second latch gears is disconnected.

5. The driving apparatus as claimed in claim 1, wherein the power disconnecting part comprises:

a fixed gear meshed with the belt driving gear;

a swing gear meshed with the fixed gear; and a floating bracket for supporting the swing gear such that the swing gear is pivotable about a central axis of the fixed gear such that the fixed gear can be meshed with and released from the swing gear.

6. The driving apparatus as claimed in claim 5, wherein the power disconnection actuating part comprises:

a connecting member connected with the floating bracket; and an actuator for actuating the connecting member.

7. The driving apparatus as claimed in claim 6, wherein the connecting member comprises:

a connecting bar projected from the floating bracket in an axial direction of the fixed gear and having an end bent perpendicularly to the axial direction;

a connecting hole formed at the end of the connecting bar in a longitudinal direction; and a connecting pin formed on the actuator and supported in the connecting hole to be movable in the longitudinal direction.

8. The driving apparatus as claimed in claim 7, wherein the actuator includes a solenoid comprising:

a plunger having a top end formed with the connecting pin;

a coil for generating a magnetic force when an electric current is applied to the coil to move the plunger; and an elastic spring for returning the plunger to its original position when no electric current is applied to the coil and thus no magnetic force is generated.

9. The driving apparatus as claimed in claim 1, wherein the image belt comprises one of an image transfer belt for transferring a toner image from a photoconductor to a recording medium and a photoconductive belt forming the photoconductor.

10. An image forming apparatus comprising:

an image forming unit having at least one photoconductor for forming a toner image;

an image transfer belt unit having an image transfer belt for transferring the toner image formed on the photoconductor to a recording medium;

an image fixing unit for fixing the toner image transferred to the recording medium; and a driving unit for driving each of the units, wherein the driving unit comprises:

a driving motor;

a belt unit driving part having a belt driving gear connected to the driving motor to drive the image transfer belt;

an image fixing unit driving part having an image fixing gear for driving an image fixing roller for fixing a toner image onto a recording medium;

a power disconnecting part for transmitting the power of the driving motor of the belt unit driving part to the image fixing unit driving part and for disconnecting the power transmission of the driving motor from the image fixing unit driving part; and a power disconnection actuating part for actuating the power disconnecting part.

11. The image forming apparatus as claimed in claim 10, wherein the image fixing unit driving part further comprises:

a unidirectional power transmission part configured such that a force applied when the recording medium is pulled in the paper-discharge direction is not transmitted from the image fixing unit driving part to the driving motor.

12. The image forming apparatus as claimed in claim 11, wherein the unidirectional power transmission part is provided at one of a plurality of gears of the image fixing unit driving part, the one gear having a first gear section and a second gear section, and wherein the unidirectional power transmission part comprises:

a swivel boss projected from one side of the first gear section;

a first latch gear formed on the one side of the first gear section;

a fixed boss projected from one side of the second gear section opposite to the one side of the first gear section and pivotably fixing and supporting the swivel boss; and a second latch gear formed on the one side of the second gear section.

13. The image forming apparatus as claimed in claim 12, wherein:

the first latch gear and the second latch gear are configured such that when one of the first and second latch gears rotates in one direction, the first latch gear and the second latch gear are meshed with one another so that power transmission from the one to the other of the first and second latch gears is connected; and when the one of the first and second latch gears rotates in the opposite direction, the first latch gear and the second latch gear pass freely over each other so that power transmission from the one to the other of the first and second latch gears is disconnected.

14. The image forming apparatus as claimed in claim 10, wherein the power disconnecting part comprises:

a fixed gear meshed with the belt driving gear;

a swing gear meshed with the fixed gear; and a floating bracket for supporting the swing gear such that the swing gear is pivotable about a central axis of the fixed gear such that the fixed gear can be meshed with and released from the swing gear.

15. The image forming apparatus as claimed in claim 14, wherein the power disconnection actuating part comprises:

a connecting member connected with the floating bracket; and an actuator for actuating the connecting member.

16. The image forming apparatus as claimed in claim 15, wherein the connecting member comprises:

a connecting bar projected from the floating bracket in an axial direction of the fixed gear and having an end bent perpendicularly to the axial direction;

a connecting hole formed at the end of the connecting bar in a longitudinal direction; and a connecting pin formed on the actuator and supported in the connecting hole to be movable in the longitudinal direction.

17. The image forming apparatus as claimed in claim 16, wherein the actuator includes a solenoid comprising:

a plunger having a top end formed with the connecting pin;

a coil for generating a magnetic force when an electric current is applied to the coil to move the plunger; and an elastic spring for returning the plunger to its original position when no electric current is applied to the coil and thus no magnetic force is generated.

18. A method of driving an image forming apparatus comprising steps of:

driving a driving motor to form a toner image on a recording medium;

detecting a jam of the recording medium while the toner image is being formed on the recording medium;

disconnecting the transmission of the power of the driving motor of a belt unit driving part to an image fixing unit driving part;

cleaning the toner image formed on an image transfer belt of a belt unit; and stopping the driving motor and pausing an operation of the apparatus.

19. The method as claimed in claim 18, wherein step of detecting the jam of the recording medium further comprises the step of outwardly displaying the jammed state.

20. The method as claimed in claim 18, wherein step of disconnecting the transmission of the power of the driving motor comprises the step of:

turning an actuator ON to separate a swing gear of a power disconnecting part from a belt driving gear of the belt unit driving part, wherein the swing gear of the power disconnecting part serves to transmit the power of the driving motor of the belt unit driving part to the image fixing unit, to disconnect the power of the driving motor from the image fixing unit.

* * * * *